US006561764B1

(12) United States Patent
Tiemann

(10) Patent No.: US 6,561,764 B1
(45) Date of Patent: May 13, 2003

(54) GAS TURBINE ROTOR WITH AN INTERNALLY COOLED GAS TURBINE BLADE AND CONNECTING CONFIGURATION INCLUDING AN INSERT STRIP BRIDGING ADJACENT BLADE PLATFORMS

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/936,990

(22) PCT Filed: Mar. 13, 2000

(86) PCT No.: PCT/EP00/02209

§ 371 (c)(1),
(2), (4) Date: Sep. 19, 2001

(87) PCT Pub. No.: WO00/57031

PCT Pub. Date: Sep. 28, 2000

(51) Int. Cl.[7] ..... F10D 11/00

(52) U.S. Cl. ..... 416/96 R; 416/193 A; 416/248

(58) Field of Search ..... 416/193 A, 190, 416/191, 220 R, 221, 248, 96 R, 97 R; 415/135, 138, 139; 277/630, 634, 643, 650

(56) References Cited

U.S. PATENT DOCUMENTS

| | | | | | |
|---|---|---|---|---|---|
| 2,755,063 | A | * | 7/1956 | Wilkinson | 416/221 |
| 2,985,426 | A | * | 5/1961 | Hunter et al. | 416/193 A |
| 3,748,060 | A | * | 7/1973 | Hugoson et al. | 416/220 R |
| 4,523,890 | A | | 6/1985 | Thompson | |

FOREIGN PATENT DOCUMENTS

| | | | | | |
|---|---|---|---|---|---|
| DE | 1258662 | | 1/1968 | | |
| DE | A1-19810567 | | 9/1998 | | |
| GB | 781771 | A | * | 8/1957 | 416/221 |
| GB | 905582 | A | * | 9/1962 | 416/220 R |
| GB | 2010404 | A | * | 6/1979 | 416/220 R |

* cited by examiner

*Primary Examiner*—Christopher Verdier
(74) *Attorney, Agent, or Firm*—Harness, Dickey & Pierce PLC

(57) ABSTRACT

A gas turbine rotor includes an internally cooled gas turbine blade which has a blade root and a blade platform with recesses into which insert strips are inserted. The gas turbine rotor is arranged in such a way that both sealing against the ingress of hot gas and the emergence of cooling air and the securing of the gas turbine blade can be effected at a low outlay and at the same time are highly reliable. The recess reaches as far as the disk-side base of the blade platform and the insert strip to have a form fit to the disk, which protects against axial displacement in a direction of insertion of the gas turbine blade.

18 Claims, 4 Drawing Sheets

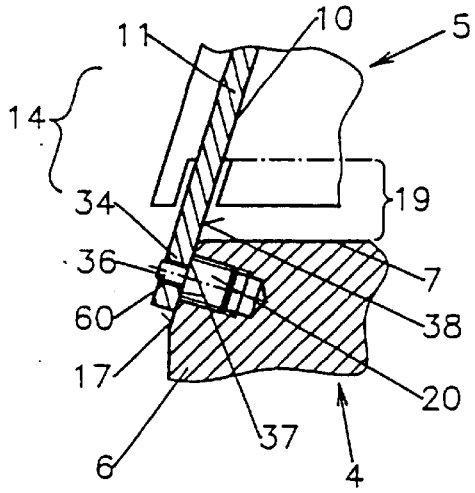
Fig.3
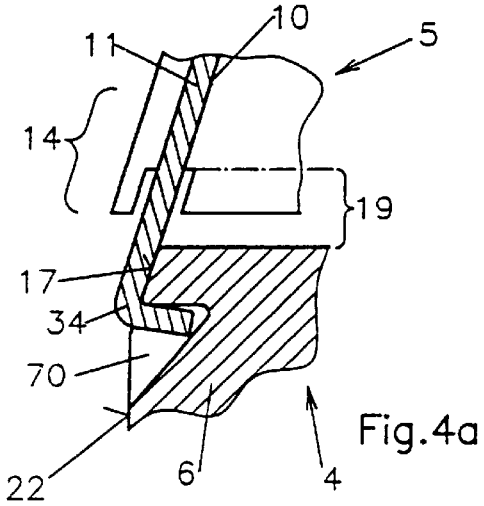
Fig.4a
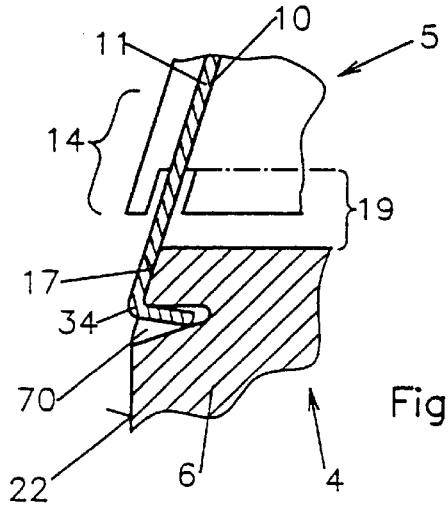
Fig.4b
Fig.6b
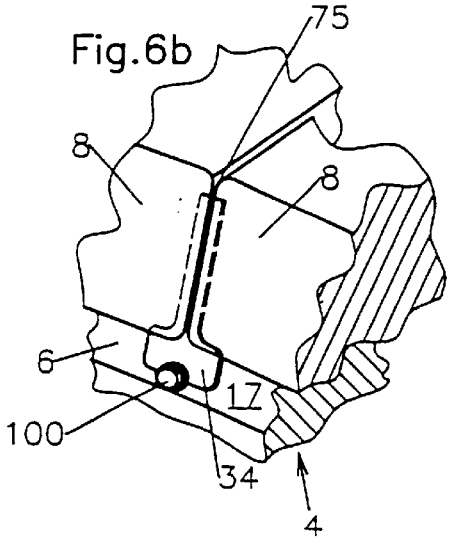
Fig.6a
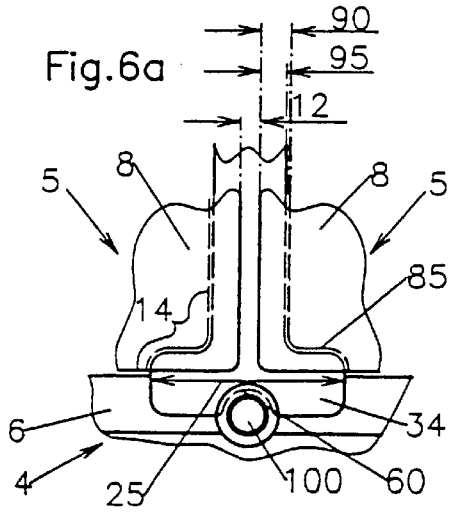

GAS TURBINE ROTOR WITH AN INTERNALLY COOLED GAS TURBINE BLADE AND CONNECTING CONFIGURATION INCLUDING AN INSERT STRIP BRIDGING ADJACENT BLADE PLATFORMS

This application is the national phase under 35 U.S.C. §371 of PCT International Application No. PCT/EP00/02209 which has an International filing date of Mar. 13, 2000, which designated the United States of America, the entire contents of which are hereby incorporated by reference.

FIELD OF THE INVENTION

The invention relates to a gas turbine rotor with an internally cooled gas turbine blade which has a blade foot and a blade platform, and with a disk possessing transverse disk grooves, into which the blade root is inserted. The blade platform is arranged outside an outer circumference of the disk and possesses, on an end wall portion of one longitudinal side, a recess into which is inserted an insert strip which engages into a corresponding recess of blade platform of a second gas turbine blade and bridges and seals off an interspace between the two blade platforms.

BACKGROUND OF THE INVENTION

DE-A1-198 10 567 discloses a sealing plate for a gas turbine moving blade. When cooling air supplied to the gas turbine moving blade escapes into the high-temperature fuel-gas duct, this results, inter alia, in a reduction in the power output of the gas turbine. The sealing plate, which is inserted into the gas turbine blade, is intended to prevent cooling air from emerging. Sealing is carried out not only by way of the sealing plate, but also by way of various sealing pins which are installed between the platforms of two moving blades. A multiplicity of sealing elements is necessary in order to produce the desired function of sealing against the emergence of cooling air.

DE-B-1 258 662 discloses a covering device for guiding the cooling gas from gas turbine disks, which consists of a plurality of individual segments sealed off relative to one another by means of sealing strips. Sealing-off is therefore carried out in an additional device which is placed in front of the gas turbine disk and the gas turbine moving blades pushed into the latter. This increases the number of elements required for constructing the seal.

U.S. Pat. No. 4,523,890 discloses sealing elements for the root regions of turbine blades. Sealing serves for reducing the cooling-air losses at the lower end of the roots. To hold the sealing elements, it is necessary to introduce into the turbine disk holding grooves into which the sealing elements are to be pushed. Complicated production steps are therefore necessary.

Similar arrangements of sealing elements are also used to prevent the ingress of hot gas into the platform region or the internal cooling system of a gas turbine moving blade. Such an ingress of hot gas may lead to severe damage to the gas turbine moving blade. In order to prevent this, a plurality of sealing elements are inserted into the blade platform on that side of the blade platform of the gas turbine moving blade which faces the hot-gas stream.

Disadvantages of the built-on parts described for sealing the platform of the gas turbine moving blade prove to be that the seal is constructed from a multiplicity of elements and therefore it becomes difficult to install the seal in the gas turbine moving blade. In addition, various securing elements also have to be attached, in order to prevent the gas turbine moving blade from slipping out of place laterally in the rotating disk of the gas turbine or even falling out.

SUMMARY OF THE INVENTION

The object of the invention is to specify a gas turbine rotor with an internally cooled gas turbine blade, in which both sealing against the ingress of hot gas and the emergence of cooling air and the securing of the gas turbine blade are to be effected at a low outlay and at the same time are highly reliable.

The object is achieved in that the recess reaches as far as a disk-side base of the blade platform, and the insert strip has a form fit to the disk which secures against axial displacement in the direction of insertion of the gas turbine blade.

The specific design of the insert strip, in particular the extension of the latter as far as the blade platform, ensure, on the one hand, that the blade platform is sealed off at its end wall portion against the penetration of hot gas or the outflow of cooling air. Sealing can be produced in a simple way and is performed by a single element which can be individually adapted in its shape to various platform configurations.

At the same time, the insert strip ensures that the gas turbine blade is fixed axially in the disk of the gas turbine rotor. The gas turbine blade, which is inserted with its blade root into a transverse disk groove of the disk and the platform of which is arranged outside the circumference of the disk, therefore cannot be displaced relative to the transverse disk groove to an undesirable extent. Axial fixing is ensured by the form fit of the insert strip to the disk. As a result, in particular, the gas turbine blade is prevented from slipping out of place in the direction of insertion in which the forces acting during the running of the gas turbine may be preferentially directed. This type of fixing can be installed and removed in a particularly stable and simple way and has low susceptibility to faults.

After thermal expansion which occurs due to the load exerted by the hot gases flowing onto the wing, the insert strip returns completely into its neutral position, for example without being continuously displaced in relation to this, which, after a few runs of the gas turbine rotor, would lead to a failure of the functions of the securing element against displacement in a direction of insertion of the gas turbine blade in the transverse disk groove.

The sealing and fixing of the gas turbine blade are accordingly carried out by way of a single element, the insert strip. This constitutes an appreciable improvement, as compared with known systems, in which a multiplicity of elements and, in conjunction with this, a high outlay in terms of installation were necessary for this purpose. Another advantage, in addition to the simplicity with which securing is carried out by means of a single insert strip, is its good handleability and the possibility of quickly exchanging, cleaning or repairing it.

Preferably, highly heat-resistant material which is stable with respect to chemical attacks is to be used, so that the onflowing hot gas does not deform or corrosively destroy the insert strip. The proposed designs of the insert strip can easily be produced with these materials because of its simple shape and have high durability even where relatively brittle materials are concerned.

Comprehensive protection against axial displacements in both directions of insertion of the transverse disk groove is afforded in that there is a recess on each of the end wall portions of one longitudinal side of the blade platform, and in that its insert strips bear on two mutually opposite disk end faces and protect against axial displacements of the gas turbine blade relative to the disk. Securing against axial displacement or against a forward and backward slipping of the gas turbine blade inserted into the transverse disk groove is ensured by the two mutually opposite insert strips which in each case have a securing form fit on the two mutually opposite disk end faces of the disk. Axial movement is inhibited in as much as axial displacements of the gas turbine blade relative to the disk either are inhibited completely or are possible only within a predetermined small scope.

If there is a recess on each of the end wall portions of each longitudinal side of the blade platform and insert strips are inserted into said recesses, each gas turbine blade is secured by four insert strips, two strips in each case ensuring securing in one direction of insertion. In this way, even if one insert strip fails or is lost, the gas turbine blade is held securely against displacement in the transverse disk groove by the remaining three. In this case, in each case two gas turbine blades share between them the two insert strips seated between them in the longitudinal side of the blade platform.

The insert strips can be mounted with little outlay and are held particularly securely in the recess in that the recess runs obliquely in the direction of a longitudinal rotor axis of the gas turbine rotor and at its disk-side end issues into a chamfer of the disk head, said chamfer being oblique corresponding to the recess. By virtue of the oblique position of the inserted insert strips, the hot gases are deflected in the direction of the gas turbine wing and are therefore utilized optimally, without being swirled excessively by the blade platform or the blade platform being subjected to an excessively high thermal load. By the insert strip projecting beyond the blade platform and coming to bear sealingly on the oblique chamfer, good sealing-off against the penetration of hot gases into the blade platform or the emergence of cooling air is ensured.

The matched slopes provide uniform one-sided bearing contact of the insert strip on the recess of the chamfer of the disk head, with the result that acting forces, for example shear forces, which occur due to a relative displacement of the gas turbine blade in relation to another gas turbine blade or of the gas turbine blade in relation to the transverse disk groove, can be reliably absorbed, without the insert strip being subjected to excessive point load.

Simple securing against loss of the insert strip, for example because of acting centrifugal forces, is afforded in that the recess is open on the disk side and, with the gas turbine blade inserted in the transverse disk groove, the insert strip can be pushed into the recess on the disk side. In this case, after being pushed in, the insert strip is held, for example, by the closed wing-side end of the recess or in that it is designed to be widened at its disk-side end and engages behind an undercut of the recess, so that a form fit counter to the acting centrifugal forces is obtained.

Forces acting on the insert strip can be absorbed effectively, without the insert strip being destroyed, in that between the disk-side end of the recess and the outer circumference of the disk there is a gap allowing relative movements between the disk and the blade platform. Acting forces are, for example, shear forces which occur due to relative movements between the disk and the blade platform or due to the gas turbine blades being displaced relative to one another in the transverse disk grooves. The dimensions of the gap at the lower end of the recess are designed in such a way that the different acting forces can be absorbed by means of corresponding elastic deformations of the attached insert strip, so that a kind of "springback effect" is achieved. Movements at the end of the insert strip are possible in the direction of insertion of the gas turbine blade and perpendicularly to this, depending on which of the acting forces have to be absorbed to a particularly great extent. If the axially displacing forces, in particular shear forces, are particularly high, it is expedient to select a gap with a very small height, so that the insert strip possesses sufficient rigidity to be capable of reliably accomplishing the axial securing.

The insert strip consists preferably of a material which possesses sufficient elastic deformation properties.

This is afforded, for example, by a highly heat-resistant alloy, such as nickel-based alloys. This makes it possible, at the same time, for the material of the insert strip to be selected in order to avoid impurities or diffusion damage and to ensure a uniform thermal expansion of the blade platform and the insert strip adapted to the material of the gas turbine blade.

A comprehensive hold of the insert strip is afforded by the recess being designed as a groove. The groove is preferably characterized by at least three walls which surround it and which form a form fit against the insert strip slipping out of place. Furthermore, the groove surrounding the sealing strip provides better sealing-off against onflowing hot gas or outflowing cooling air. The groove may be designed in such a way that it is laid sealingly around the insert strip and therefore seals off without additional sealing materials. In another embodiment, knife edges are attached to the groove and engage into the insert strip.

The groove provides, furthermore, increased safety against the actions of forces on the insert strip, for example shear forces, occurring due to relative displacements, of the platforms in relation to one another or of the platforms in relation to the disk. The groove is in this case opened on the side which is nearest to the adjacent platform. The insert strip can thereby easily be pushed into the two mutually opposite grooves and is seated there very securely.

An insert strip can easily be prevented from slipping through under the action of centrifugal forces by the recess being wider at its disk-side end than on its remaining part. A form fit is thereby made against the insert strip slipping through, and the latter can be inserted from the disk-side end of the recess, without the groove at the same time having to be closed at the upper end.

A secure hold of the insert strip when the gas turbine is at a standstill is obtained in that the insert strip is fixed in its push-in position on the disk. The insert strip is thereby prevented from slipping out of the recess even at a standstill when it is not pressed outward by the centrifugal-force load as a result of the rotational movement. Furthermore, fixing to the disk affords an improved hold against slipping out of place axially. Fixing may be carried out, for example, by means of a screw or a bolt which is presented below the insert strip and does not have to engage into the latter. This particularly simple type of fixing can be effected quickly and can also be canceled again quickly, even when corrosion has occurred.

To ensure that slip-through resistance is secured against loosening under the action of the centrifugal-force load, it is advantageous that there serves for fixing the insert strip a screw part which engages into a recess of the insert strip and is supported on the insert strip under the action of centrifugal force. By engaging into the recess of the insert strip, the screw part secures the insert strip against slipping out when the gas turbine is at a standstill. At the same time, since the screw part is supported on the insert strip under the action of centrifugal force, the insert strip prevents the screw part from slipping out. The two elements accordingly secure one another. This reduces the number of elements required. At the same time, the insert strip, in turn, can easily be removed, for example when gas turbine blades are to be exchanged.

The screw part can be supported on the insert strip in that the screw part has a projection which, when the gas turbine is at a standstill, bears directly on that surface of the insert strip which faces the disk, another part of the screw part reaching through the recess of the insert strip. In this case, it is necessary to ensure that that part of the screw part which is supported on the insert strip does not reach into emptiness as a result of the usual displacements occurring when the insert strip is under thermal load. This may be ensured in a simple way by the projection of the screw part coming to bear on the disk-side side of the insert strip all around the recess of the insert strip.

Securing the insert strip against falling out and/or securing the insert strip against being thrown out under the action of the centrifugal force, no additional parts being required, is accomplished in that the insert strip engages at a disk-side end into a securing recess of the disk end face. For engagement into this securing recess, the insert strip may, for example, already possess a bent-round end before insertion or be bent round after insertion into the securing recess. A further possibility is for the insert strip to possess an attached projection which, in the push-in position, matches the securing recess.

By virtue of such engagements into a securing recess in the disk end face, the insert strip can easily be removed for possible maintenance purposes or in the event of a failure of the gas turbine blade without additional tools or without the risk of the securing element caking together with the material under diffusive or corrosive attack at high operating temperatures. On the other hand, that part of the insert strip which engages into the securing recess may be designed with virtually any desired dimensions, so that securing is reliably afforded even in the event of high external forces. Furthermore, some play of the insert strip which engages into the securing recess is possible, so that thermal expansions or acting shear forces can be absorbed more easily without failure or damage to the insert strip.

Securing which is independent of the disk can be provided in that a securing strip leads through two insert strips below the blade platform and is bent round at its ends. Securing against slipping through is thereby afforded independently of the disk. This is advantageous when high shear forces occur which subject an insert strip fastened to the disk to high load and would possibly loosen it. This additional safety aspect is important particularly in the case of high temperature fluctuations or sharply alternating acting forces.

A good lateral hold and sealing-off of the insert strip is afforded in that the insert strip engages with a predetermined engagement depth into the recess of the blade platform, and in that the engagement depth of the insert strip into the recess is greater than the interspace between two adjacent blade platforms. Even under pronounced relative displacements of the blade platforms in relation to one another, the insert strip is held captive in the two recesses and seals off effectively here in a labyrinth-like manner.

BRIEF DESCRIPTION OF THE DRAWINGS

The gas turbine rotor with internally cooled gas turbine blades is explained in more detail by means of the exemplary embodiments illustrated in the drawings in which:

FIG. 3 shows a side view of a screw fixing of the insert strip, FIGS. 4*a, b* shows securing-groove fixings of the insert strip, FIG. 6*a* shows a top view of an insert strip widened on the disk side, and FIG. 6*b* shows a perspective view of a widened insert strip.

DETAILED DESCRIPTION OF THE PREFERRED EMBODIMENTS

Figure 1:
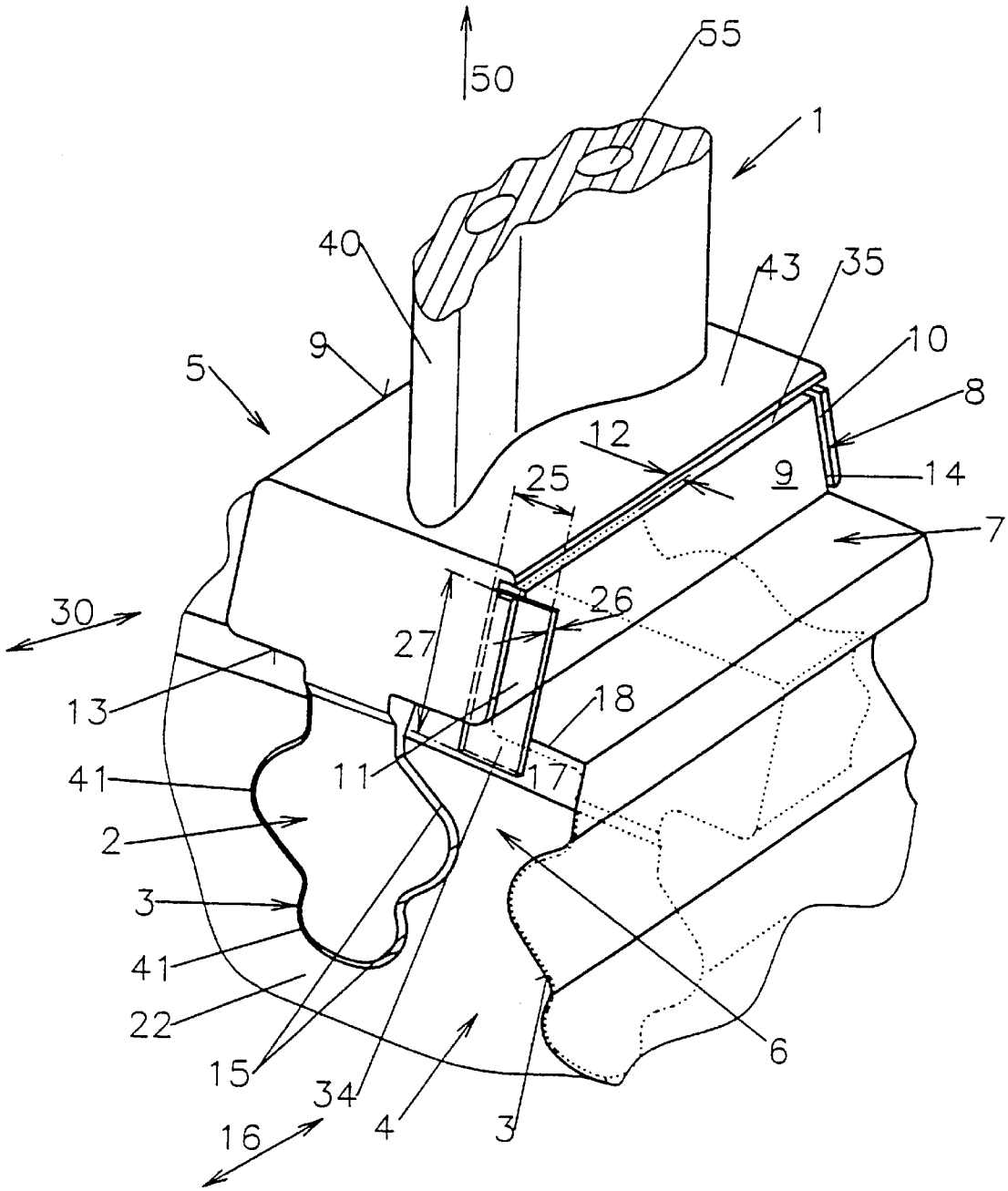
FIG. 1 shows a perspective view of a detail of the disk with an inserted gas turbine blade.

FIG. 1 illustrates diagrammatically, not true to scale, a basic construction of part of the gas turbine rotor, to be precise an outer part—the head part 6—of the disk 4. The disk 4 possesses peripheral transverse disk grooves 3 which are open toward its circumference 7 and run essentially parallel to the rotor longitudinal axis 16, but may also be set obliquely to this. The transverse disk grooves 3 are equipped with undercuts 15. A gas turbine blade 1 is inserted with its blade root 2 into a transverse disk groove 3 in the direction of insertion 30 of the transverse disk groove 3. The blade root 2 is supported with longitudinal ribs 41 on the undercuts 15 of the transverse disk groove 3. In this way, during rotations of the disk 4 about the rotor longitudinal axis 16, the gas turbine blade 1 is held counter to centrifugal forces occurring in the direction of the longitudinal axis 50 of the gas turbine blade 1. Additional securing against loss then still has to take place merely in order to prevent slipping out in the direction of insertion 30 in the transverse disk groove 3. In the present invention, securing takes place with the aid of the insert strip 11, as illustrated further below.

Above the blade root 2, the gas turbine blade 1 possesses a widened region, what is known as the blade platform 5. A wing 40 of the gas turbine blade 1 is located on an outer side 43 of the blade platform 5, said outer side being located opposite a disk-side base 13 of the blade platform 5. The hot gases required for operating the gas turbine blade 1 flow past the wing 40 and generate a torque on the disk 1. At high operating temperatures of the gas turbine rotor, the wing 40 of the gas turbine blade 1 requires an internal cooling system which is not fully illustrated here. Only the supply lines 55 for the internal cooling system, through which the cooling air is introduced into the internal cooling system, are illustrated.

The cooling air is conducted by a feed line, not illustrated, through the disk 4 into the blade root 2 of the gas turbine blade 1 and from there out to the supply lines 55 of the internal cooling system. In order to prevent the cooling air from emerging prematurely in the region of the blade root 2 or of the blade platform 5, there are insert strips 11.

In particular, hot gas will be prevented from penetrating between two gas turbine moving blades 1 into the blade platform 5 or the internal cooling system and from damaging these regions. A second gas turbine blade 1 inserted into an adjacent transverse disk groove is illustrated by broken lines. The longitudinal sides 9 of the two gas turbine blades 1 have an interspace 12. The longitudinal sides 9 have recesses 10, into which an insert strip 11 is inserted.

For this purpose, the recess 10 is designed to reach as far as the disk-side base 13 of the blade platform 5. The insert strip 11, in turn, reaches beyond the disk-side end 14 of the recess 10 and comes to bear at its disk-side end 34 on a chamfer 17 on the end face 22 of the disk 4. The insert strip 11 thus has a form fit to the disk 4 which protects against the axial displacement of the gas turbine blade 1 in the direction of insertion 30 of the gas turbine blade 1.

In this way, by coming to bear snugly in the recess 10 and on the chamfer 17, the insert strip 11 performs a function of sealing off against the penetration of hot gas and the emergence of cooling air and also a function of protecting against the gas turbine blade 1 slipping out of place in the transverse disk groove 3 or in the direction of insertion 30. A highly heat resistant material, for example a nickel-based alloy, is preferably used for the insert strip 11.

When a recess 10 is present on each of the two end wall portions 8 of one longitudinal side 9 and in each case an insert strip 11 is inserted into a recess 10 and comes to bear in each case on one of the two mutually opposite disk end faces 22, the gas turbine blade 1 is secured relative to the disk 4 in both possible directions of insertion 30. The opposite longitudinal side 9 of the blade platform 5, in turn, possesses, on its end wall portions 8 of the longitudinal side 9, recesses 10 into which insert strips 11 are inserted. A gas turbine blade 1 is thus secured by altogether four insert strips 11. To improve sealing, a sealing strip is pushed longitudinally into the groove 35 of the longitudinal sides 9.

Figure 2:
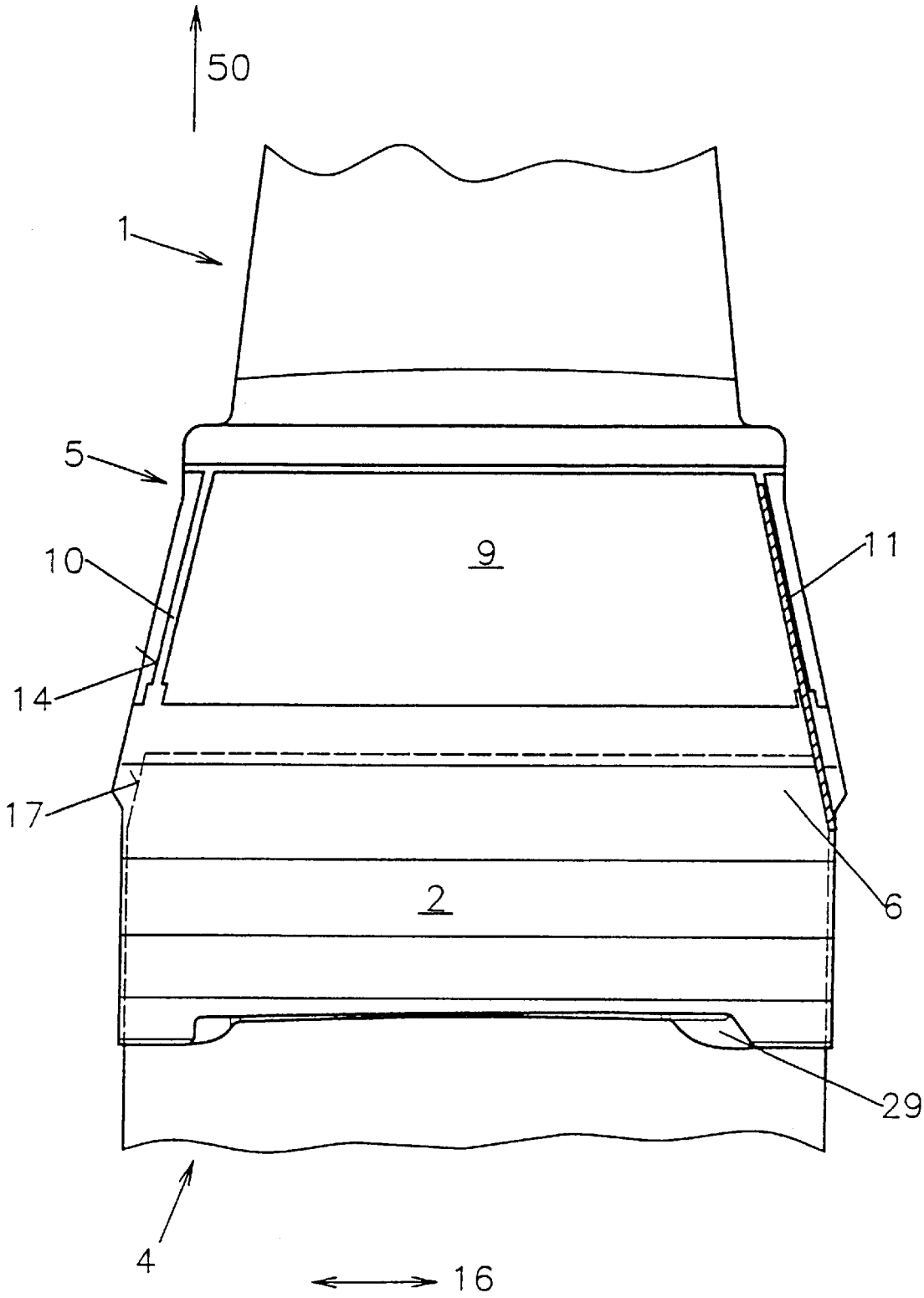
FIG. 2 shows a side view of a gas turbine blade with an insert strip.

FIG. 2 shows a lateral view of the gas turbine blade 1 with an inserted insert strip 11. The recess 10 runs obliquely, inclined in the direction of a rotor longitudinal axis 16 of the gas turbine rotor, and issues, at its disk-side end 14, into a chamfer 17 of the disk head 6, said chamfer being sloped corresponding to the recess 10. That region of the blade platform 5 which is on the disk-head side is thereby protected very effectively against the penetration of hot gas. The cooling air which is introduced into the gas turbine blade through the access 29 to the internal cooling system cannot escape through the interspace 12 before the wing tip of the blade wing 40 is reached.

By lying on the chamfer 17, the insert strip 11 has a large bearing surface, with a result that axially acting forces can be absorbed effectively. The insert strip 11 can be inserted into the recess 10 from below at the disk-side end 14 of the recess 10.

The insert strip is thereby secured against slipping out as a result of acting centrifugal forces.

FIG. 3 shows a disk-side end 14 of the recess 10 with an inserted insert strip 11. Between the disk-side end 14 of the recess 10 and the outer circumference 7 of the disk 4 there is a gap 19 allowing axial relative movements between the disk 4 and the blade platform 5. The gap 19 makes it possible, under the action of transverse forces, to have an elastic deformation of the inserted insert strip 11, so that a kind of "springback effect" is achieved. Here, as in the previous figures, the recess 10 is designed as a groove. The insert strip 11 thereby sits, held securely and sealed off effectively, in the recess 10.

The insert strip 11 is fixed in its push-in position on the disk 4. In this way, the insert strip is prevented from slipping out under the action of gravitational force and the securing effect of the insert strip 11 against axial displacement of the gas turbine blade 1 is increased. A screw part 20 serves for fixing the insert strip 11. The screw part 20 is inserted into the disk head 6 in the region of the chamfer 17. The screw part 20 possesses a head 36 and peripheral shoulders 37. The head 36 projects into a recess 60 of the insert strip 11 and the shoulders 37 are supported on the inside 38 of the insert strip 11. The shoulders 37 come to bear sealingly on the inside 38 of the insert strip 11, so that the insert strip 11 prevents the screw part 20 from slipping out under acting centrifugal forces and at the same time the insert strip 11 is secured by the head 36 of the screw part 20 against slipping out when the gas turbine rotor is at a standstill.

FIG. 4*a* shows another possible design of the disk-side end 34 of the insert strip 11. The insert strip 11 engages at its disk-side end 34 into a securing recess 70 of the disc end face 22.

The securing recess 70 supports the insert strip 11 both against falling out and against slipping out of place laterally. The end 14 is bent round preferably after the insert strip 11 is pushed into the recess 70. The insert strip 11 may also be bent round at its disk-side end 34 and pushed in before insertion. A precondition for this is a sufficient springiness of the strip 11 and/or a sufficient slope of the recess 70.

FIG. 4*b* shows the disk-side securing of the insert strip 11 from FIG. 4*a*, and the securing recess 70 has a flatter slope. The inserted insert strip 11 is thereby held captive even during slight axial displacements.

Figure 5:
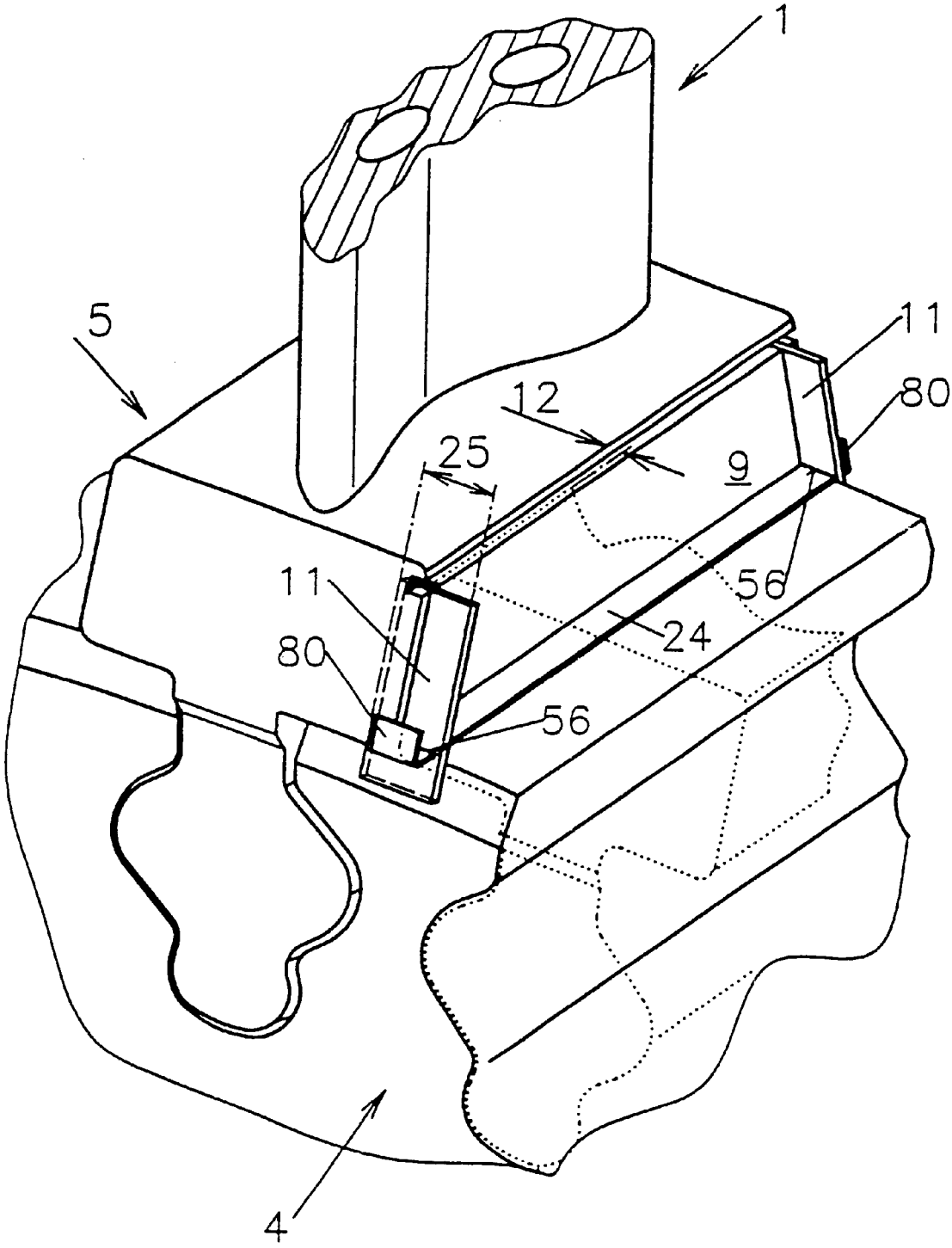
FIG. 5 shows a perspective view of a gas turbine blade with an inserted securing strip.

FIG. 5 shows a further possibility for securing in the region of the disk-side end 34 of the insert strip 11. A securing strip 24 passes through under the blade platform 5, leads in each case through a passage orifice 56 in two mutually opposite insert strips 11 and is bent round at its ends 80. The insert strips 11 are thereby prevented from slipping out. The disk 4 is therefore not affected by bores or orifices for securing the insert strips 11. This type of securing affords increased stability with respect to acting shear forces, since an insert strip 11 of this kind has some play for displacement. Furthermore, the securing can easily be removed again without permanent damage to the disk 4. Moreover, it is simpler to remove the securing, because securing of this kind, even at high temperatures, generally does not make an undesirable material bond with the surrounding material or, where appropriate, can more easily be released from this bond again. The securing strip 24, like the insert strips 11, should accordingly consist of highly heat resistant material.

The orifices 56 should be matched as closely as possible to the securing strip 24, so that hot gas does not penetrate into the blade platform 5. The width of the securing strip 24 may be adapted to the strength of the acting forces, and the ends 80 may also pass through below the insert strips 11 and, if appropriate, be wider than the width 25 of these.

FIGS. 6*a* and 6*b* show an exemplary embodiment of an insert strip 11 which at its disk-side end 34 has a width 25 enlarged in relation to the remaining part. The recess 10 is accordingly made wider at its disk-side end 14 than on its remaining part. The recess has undercuts 85. The insert strip 11 is thereby prevented from slipping out under acting centrifugal forces even when a wing-side end 75 of the recess 10 is open. No gap 19 is provided, and the distance of the blade platform 5 from the disk circumference 7 is kept small. A gas turbine blade 1 subjected to high forces acting in the direction of insertion 30 can thereby be held securely.

In an alternative design, the width 25 of the insert strip 11 may also decrease continuously from its disk-side end 34 to its wing-side end 75. To secure an insert strip 11 of this type against falling out when the gas turbine rotor is at a standstill, a screw part 100 or a bolt may be arranged below the insert strip 11 on the disk end face 22.

At the narrow interspace 12, the insert strip 11 offers a particularly small working surface with respect to hot gases or is sealed off effectively against the penetration of the hot gases. In this case, the insert strip 11 engages with a predetermined engagement depth 95 into the recess 10 of the blade platform 5 having the depth 90. The engagement depth 95 of the insert strip 11 in the recess 10 is greater than the interspace 12 between two adjacent blade platforms 5. This makes it possible for the insert strip 11 to be held very securely in the recess 10.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas turbine rotor, comprising:

an internally cooled gas turbine blade, the blade including a blade root and a blade platform; and a disk including transverse disk grooves, into one of which the blade root is inserted, the blade platform being arranged outside an outer circumference of the disk and including, on an end wall portion of one longitudinal side, a recess into which is inserted an insert strip which engages into a corresponding second recess of a second blade platform of a second gas turbine blade and bridges and seals off an interspace between the two blade platforms, wherein the recess reaches as far as a disk-side base of the blade platform, and wherein the insert strip includes a form fit to the disk which protects against axial displacement in a direction of insertion of the gas turbine blade, and wherein the recess runs obliquely in the direction of a longitudinal rotor axis of the gas turbine rotor and at its disk-side end, issues into a chamfer of the disk head, said chamfer being oblique corresponding to the recess.

2. The gas turbine rotor as claimed in claim 1, wherein a recess is included on each of the end wall portions of one longitudinal side of the blade platform, and in which its insert strips bear on two mutually opposite disk end faces and protect against axial displacements of the gas turbine blade relative to the disk.

3. The gas turbine rotor as claimed in claim 1, wherein, with the gas turbine blade inserted into the transverse disk groove, the insert strip can be pushed into the recess on the disk side and is secured counter to centrifugal forces by form fit on at least one of the disk and the blade platform.

4. The gas turbine rotor as claimed in claim 1, wherein between the disk-side end of the recess and the outer circumference of the disk, there is a gap allowing relative movements between the disk and the blade platform.

5. The gas turbine rotor as claimed in claim 1, wherein the recess is designed as a groove.

6. The gas turbine rotor as claimed in claim 1, wherein the recess is wider at its disk-side end than in its remaining part.

7. The gas turbine rotor as claimed in claim 1, wherein the insert strip is fixed in its push-in position on the disk.

8. The gas turbine rotor as claimed in claim 1, wherein a screw part serves for fixing the insert strip, the screw part engaging into a recess of the insert strip being supported on the insert strip under the action of centrifugal force.

9. The gas turbine rotor as claimed in claim 1, wherein the insert strip engages at its disk-side end into a securing recess of the disk end face.

10. The gas turbine rotor as claimed in claim 1, wherein a securing strip leads through two insert strips below the blade platform and is bent round at its ends.

11. The gas turbine rotor as claimed in claim 1, wherein the insert strip is designed in the form of at least one of a wire and of a metal sheet.

12. The gas turbine rotor as claimed in claim 1, wherein the insert strip engages with a predetermined engagement depth into the recess of the blade platform, and wherein the engagement depth of the insert strip into the recess is greater than the interspace between two adjacent blade platforms.

13. The gas turbine rotor as claimed in claim 1, wherein, with the gas turbine blade inserted into the transverse disk groove, the insert strip can be pushed into the recess on the disk side and is secured counter to centrifugal forces by form fit on at least one of the disk and the blade platform.

14. A gas turbine rotor, comprising:

an internally cooled gas turbine blade, the blade including a blade root and a blade platform; and a disk including transverse disk grooves, into one of which the blade root is inserted, the blade platform being arranged outside an outer circumference of the disk and including, on an end wall portion of one longitudinal side, a recess into which is inserted an insert strip which engages into a corresponding second recess of a second blade platform of a second gas turbine blade and bridges and seals off an interspace between the two blade platforms, wherein the recess reaches as far as a disk-side base of the blade platform, and wherein the insert strip includes a form fit to the disk which protects against axial displacement in a direction of insertion of the gas turbine blade, wherein a recess is included on each of the end wall portions of one longitudinal side of the blade platform, and in which its insert strips bear on two mutually opposite disk end faces and protect against axial displacements of the gas turbine blade relative to the disk, and wherein the recess runs obliquely in the direction of a longitudinal rotor axis of the gas turbine rotor and at its disk-side end, issues into a chamfer of the disk head, said chamfer being oblique corresponding to the recess.

15. The gas turbine rotor as claimed in claim 14, wherein, with the gas turbine blade inserted into the transverse disk groove, the insert strip can be pushed into the recess on the disk side and is secured counter to centrifugal forces by form fit on at least one of the disk and the blade platform.

16. The gas turbine rotor as claimed in claim 14, wherein between the disk-side end of the recess and the outer circumference of the disk, there is a gap allowing relative movements between the disk and the blade platform.

17. The gas turbine rotor as claimed in claim 14, wherein the recess is designed as a groove.

18. The gas turbine rotor as claimed in claim 14, wherein the recess is wider at its disk-side end than in its remaining part.

* * * * *